US007748054B2

(12) United States Patent
Araquistain

(10) Patent No.: US 7,748,054 B2
(45) Date of Patent: Jul. 6, 2010

(54) DISPOSABLE OVER-GARMENT

(76) Inventor: Silvia Araquistain, 411 Longview Cir., Hiawassee, GA (US) 30546

( * ) Notice: Subject to any disclaimer, the term of this patent is extended or adjusted under 35 U.S.C. 154(b) by 172 days.

(21) Appl. No.: 12/032,811

(22) Filed: Feb. 18, 2008

(65) Prior Publication Data

US 2009/0205098 A1 Aug. 20, 2009

(51) Int. Cl.
*A41D 13/04* (2006.01)

(52) U.S. Cl. ..... 2/50; 2/52

(58) Field of Classification Search ..... 2/50, 2/52, 48, 88, 49.1, 49.2, 51, 49.3–49.5, 46, 2/114, 69, 87

See application file for complete search history.

(56) References Cited

U.S. PATENT DOCUMENTS

| | | | | | |
|---|---|---|---|---|---|
| 1,220,088 | A | | 3/1917 | Gavin | |
| 1,511,737 | A | * | 10/1924 | Lord | 2/50 |
| 2,424,680 | A | * | 7/1947 | Doyle | 2/52 |
| 2,498,471 | A | * | 2/1950 | Williams | 2/49.4 |
| 2,881,447 | A | * | 4/1959 | Shackelford | 2/49.1 |
| 2,907,042 | A | * | 10/1959 | Murphy | 2/48 |
| 3,001,646 | A | * | 9/1961 | Cooper | 2/49.1 |
| 3,146,464 | A | * | 9/1964 | Burnett | 2/49.3 |
| 3,416,157 | A | | 12/1968 | Marder et al. | |
| 3,665,518 | A | * | 5/1972 | Leadford | 2/88 |
| 3,793,644 | A | * | 2/1974 | Kellner | 2/48 |
| 3,916,447 | A | | 11/1975 | Thompson | |
| 3,945,048 | A | | 3/1976 | Shearer | |
| 3,999,221 | A | * | 12/1976 | Hannigan | 2/49.1 |
| 4,186,443 | A | | 2/1980 | Britzman | |
| 4,313,229 | A | | 2/1982 | Villafane | |
| 4,330,888 | A | | 5/1982 | Klepfer | |
| 4,416,025 | A | | 11/1983 | Moret et al. | |
| 4,442,552 | A | | 4/1984 | Bolick et al. | |
| 4,543,668 | A | | 10/1985 | Franklin | |
| 4,646,364 | A | | 3/1987 | O'Larey | |
| 4,771,480 | A | | 9/1988 | Stimson et al. | |
| 4,884,299 | A | | 12/1989 | Rose | |
| D314,078 | S | | 1/1991 | Wiederhold et al. | |
| 5,001,784 | A | * | 3/1991 | Orlando, Jr. | 2/114 |

(Continued)

FOREIGN PATENT DOCUMENTS

| | | | |
|---|---|---|---|
| EP | 1107673 | A1 | 6/2001 |

(Continued)

*Primary Examiner*—Amy B Vanatta
(74) *Attorney, Agent, or Firm*—Russ Weinzimmer; Russ Weinzimmer & Associates

(57) ABSTRACT

A protective over-garment is disclosed that can be manufactured entirely by making cuts in a single sheet of plastic or other flexible material. In preferred embodiments it is disposable. The sheet has a neck hole in the center and covers the user's shoulders, upper arms, back, and chest. A cut radiating from the hole allows insertion of the user's head. The rim of the hole is held against the wearer's neck by tying together two strips of material formed by cuts that partially separate them from the sheet. Similar strips can hold the first cut and/or the sides of the garment closed. In preferred embodiments the sheet can be rectangular, hourglass, or double-hourglass in shape, and/or the sheet can be folded to fit in a standard home hair coloring kit. Cuts can be perforated, and the garments can be manufactured as a continuous length of sheets joined at perforated intersections.

20 Claims, 8 Drawing Sheets

U.S. PATENT DOCUMENTS

| | | | | |
|---|---|---|---|---|
| 5,054,124 | A | 10/1991 | Darvas | |
| 5,100,710 | A * | 3/1992 | Rizzuto | 428/43 |
| 5,572,740 | A | 11/1996 | Geniesse | |
| 5,963,986 | A | 10/1999 | Deppen | |
| 6,119,268 | A | 9/2000 | McCauslin | |
| 6,345,392 | B1 | 2/2002 | Rios | |
| 2003/0088902 | A1 | 5/2003 | Levy | |
| 2004/0049828 | A1 | 3/2004 | Moses | |
| 2007/0028343 | A1 * | 2/2007 | Makowka | 2/48 |

FOREIGN PATENT DOCUMENTS

| | | | |
|---|---|---|---|
| EP | 1107673 | A4 | 10/2004 |
| GB | 2220557 | B | 12/1992 |
| JP | 2000197515 | A2 | 7/2000 |
| JP | 2002194604 | A2 | 7/2002 |
| WO | 9211775 | A1 | 7/1992 |
| WO | 0011978 | A1 | 3/2000 |

* cited by examiner

DISPOSABLE OVER-GARMENT

FIELD OF THE INVENTION

The invention relates generally to protective over-garments, and more particularly to disposable over-garments for use in barbering, beauty salons, dental treatments, nursing homes, hospitals, home hair coloring, and the like.

BACKGROUND OF THE INVENTION

Much effort has been directed toward providing easily and economically manufactured and functionally satisfactory protective over-garments, such as capes and aprons. The need exists not only for professional use in businesses such as barbershops, beauty salons, and the like, but also for home use when cooking, applying makeup, applying home hair coloring, and the like. The need has grown over time as costs for purchasing, laundering, and otherwise maintaining such over-garments have increased.

Rolls of disposable paper or plastic over-garments have been suggested. The use of transverse perforations for severance of disposable over-garments from a roll thereof has been suggested. Folded sheet stocks in roll form have also been suggested. A variety of means for attaching the over-garment to the wearer have also been suggested, including snaps, VELCRO, and other fastening means, as well as adhesively attaching the garment to the user.

However, all known over-garment designs suffer from manufacturing, structural, and/or functional problems that add to the cost of manufacture and/or diminish the utility and functionality for the user. For example, many of the known over-garments include a plurality of components that must be manufactured separately and then sewn or otherwise assembled together to form the complete garment, thereby increasing the complexity and cost of manufacture. Others cannot be adjusted to fit snugly around the neck of the wearer, and/or provide only limited coverage of the wearer, thereby rendering them unsuitable for many applications such as barbering, dentistry, and home hair coloring.

SUMMARY OF THE INVENTION

A protective outer-garment is disclosed that can be manufactured entirely by making cuts in a single sheet of flexible material, which in preferred embodiments is a liquid-repelling material such as plastic. The sheet has a hole approximately in the center that is placed around the neck of a user when wearing it, while the remainder of the sheet covers the user's shoulders, upper arms, back, and chest. A first cut radiating outward from the hole can be opened to allow passage of the user's head through the hole, after which the first cut can be closed and the hole can be sealed against the wearer's neck by tying together two strips of the flexible material that are formed near the hole by a second and a third cut that partially separate the strips from the sheet. In preferred embodiments the material and manufacturing costs are low enough to make the over-garment disposable, and in some preferred embodiments the over-garment can be folded or otherwise compressed so as to fit conveniently into a package, such as a rectangular package measuring approximately 2 inches by 3 inches by 6 inches in which a typical home hair coloring kit is sold.

In some preferred embodiments, the sheet is approximately rectangular in shape. In some of these preferred embodiments at least one pair of side tying strips is included that can be tied together to hold the sides closed while being worn. The side strips are formed by cuts that partially separate them from the sides of the over garment. In further preferred embodiments a plurality of sheets can be manufactured by passing a continuous length of the flexible material through a device that makes the cuts. In still further preferred embodiments, a plurality of sheets is manufactured as a continuous length of sheets that are separated by perforations and can be rolled or folded to facilitate storage, transport, and dispensing of the garments.

In some preferred embodiments the sheet has approximately an hourglass shape, so that when it is worn it is wider at the hips and narrower at the shoulders. In other preferred embodiments the sheet has approximately a double hourglass shape, so that when it is worn it is wider at the hips and shoulders and narrower at the waist.

In still other preferred embodiments the hole and/or some or all of the cuts are perforated and must be separated before use. In other preferred embodiments the strips that secure the hole to the user's neck can be crossed over each other, extended around the user's neck, and tied together, so that when the user's neck is smaller in circumference than the circumference of the hole, the edges of the first cut will overlap and the rim of the hole will be held firmly against the user's neck.

In preferred embodiments, the first cut extends to the edge of the sheet, allowing the sheet to be wrapped around the user's neck without risk of disturbing the user's hair. In still other preferred embodiments, additional strips of material, also formed by cuts that partially separate them from the sheet, can be tied together to hold the first cut closed. And in still other preferred embodiments the sheet is large enough to cover the user's lap.

The method of the invention includes providing an outer-garment as described above, opening the first cut, placing a user's head through the hole and opened cut, allowing the garment to rest on the shoulders of the user, and tying together the two strips formed near the hole.

DETAILED DESCRIPTION OF PREFERRED EMBODIMENTS

Figure 1A:
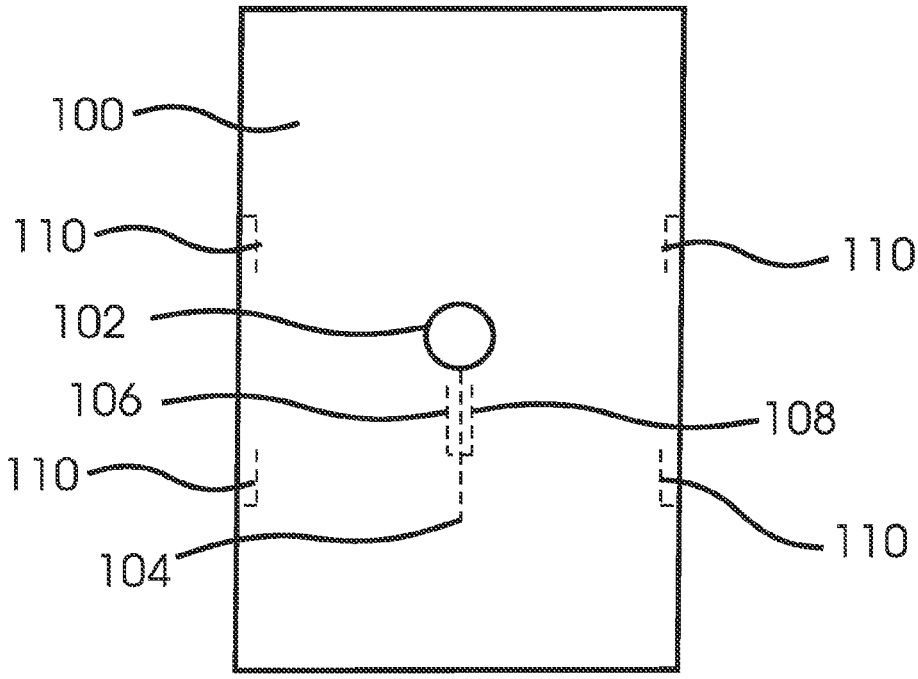
FIG. 1A is a view of the sheet of the invention from above, in an embodiment where the sheet is rectangular in shape and all of the cuts are perforated and have not yet been separated.

With reference to FIG. 1A, the invention comprises a single sheet of flexible material 100 with a hole 102 located approximately in the center. A first cut 104 radiates outward from the hole, and a second cut 106 and a third cut 108, located on either side of the first cut 104, partially separate a pair of neck tying strips from the sheet so that the neck tying strips can be tied together to hold the rim of the hole firmly against a user's neck. Additional cuts 110 in the sides of the sheet 100 partially separate side tying strips from the sheet 100 so that the strips 110 can be tied together to hold the sides of the over-garment closed when the over-garment is worn. In the embodiment shown in FIG. 1A, the sheet is rectangular in shape, and all of the cuts are perforated and must be separated before use.

Figure 1B:
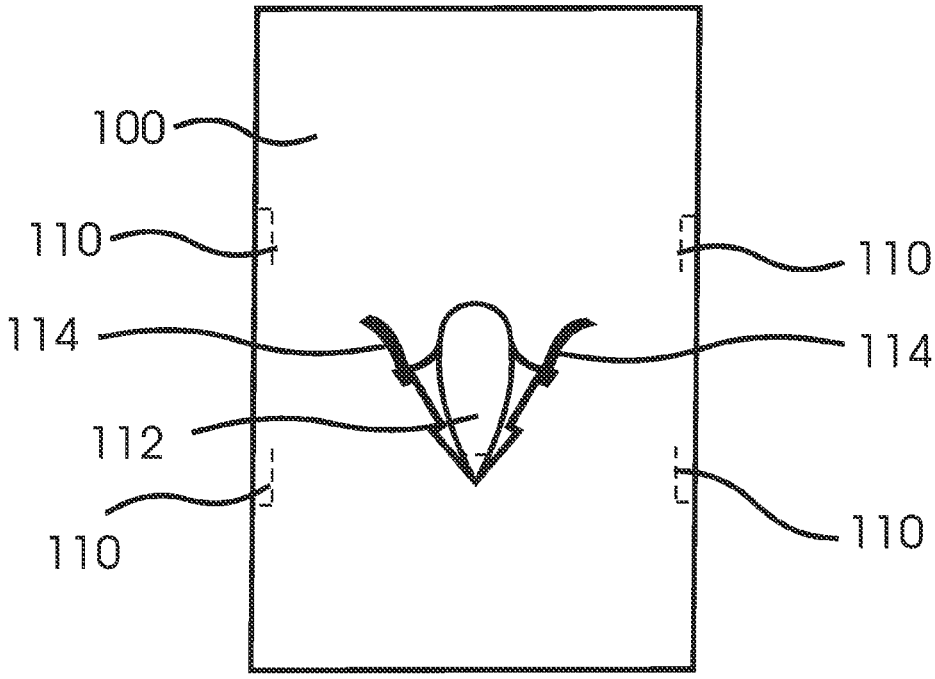
FIG. 1B shows the embodiment of FIG. 1A with the first, second, and third cuts separated and the combined opening formed by the hole and the first cut thereby enlarged to allow passage of a user's head.

FIG. 1B shows the same embodiment as FIG. 1A, with the first cut 104 separated and spread apart to create an opening 112 that is large enough for the head of a user to pass through. The second cut 106 and the third cut 108 have also been separated, forming the two neck tying strips 114.

Figure 2A:
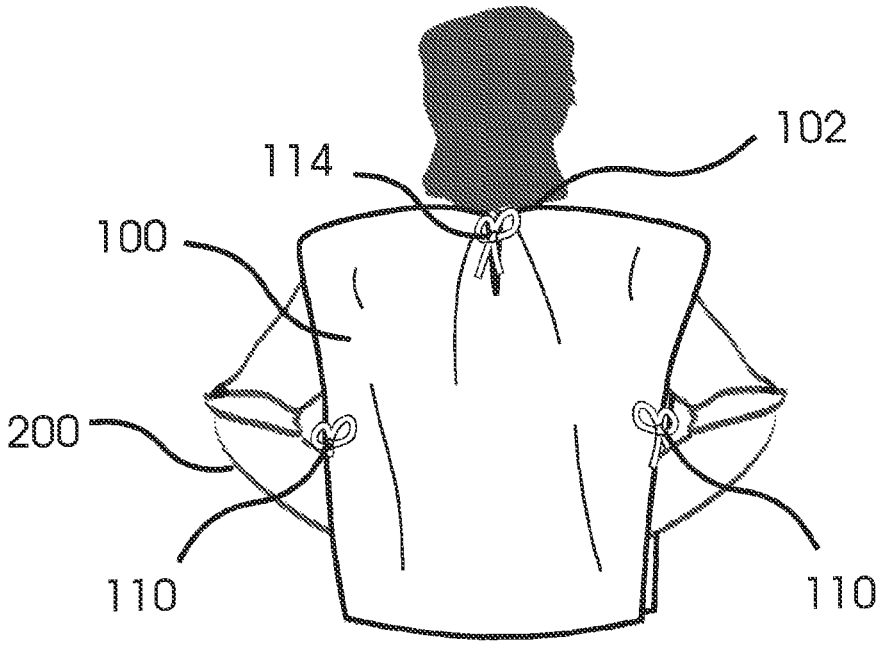
FIG. 2A is a perspective view from behind of a user wearing the embodiment of FIG. 1A and FIG. 1B.
Figure 2B:
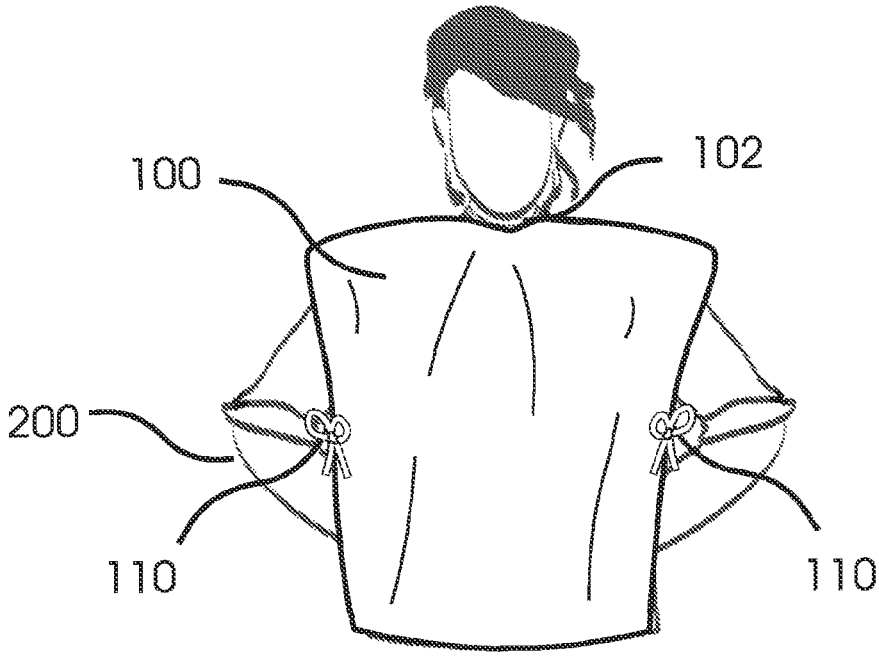
FIG. 2B is a perspective view from the front of a user wearing the embodiment of FIG. 1A and FIG. 1B.

FIG. 2A shows a perspective rear view of a user wearing the embodiment of the over-garment illustrated in FIG. 1A and FIG. 1B. The hole 102 has been placed over the user's neck, the neck straps 114 have been tied together to close the hole about the user's neck, and the side straps 110 have been tied together to close the sides. FIG. 2B shows a front view of the same embodiment as in FIG. 2A.

Figure 3A:
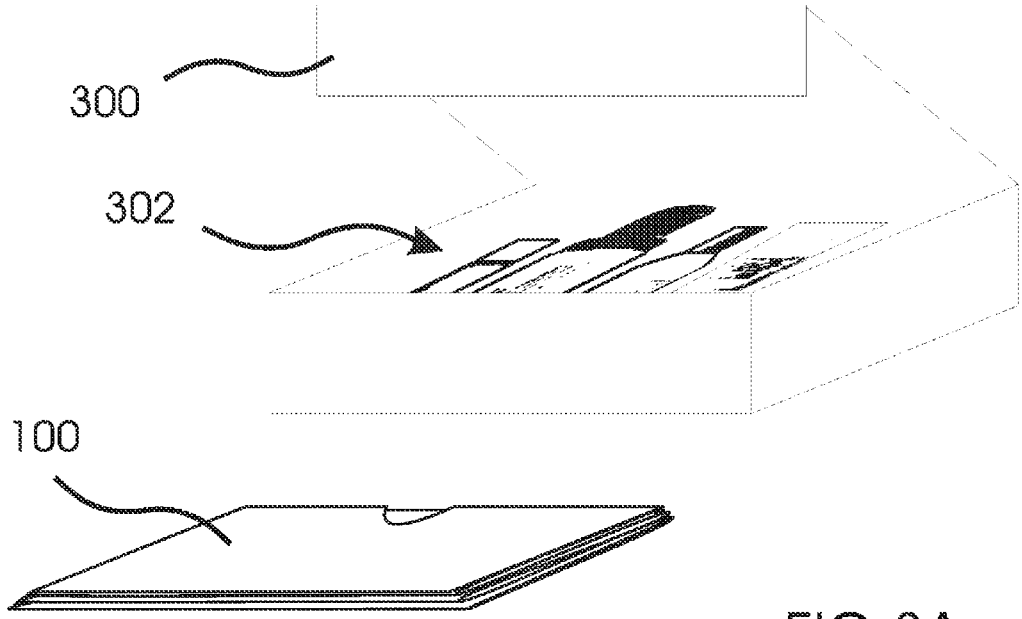
FIG. 3A is an illustration of a folded over-garment of the present invention folded and ready for placement inside of a box containing a typical home hair coloring kit.
Figure 3B:
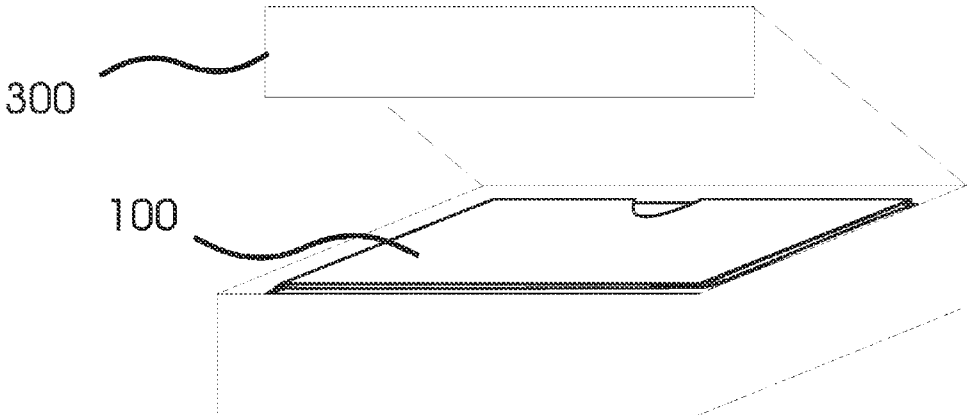
FIG. 3B is an illustration of a folded over-garment of the present invention placed inside of a box containing a typical home hair coloring kit.

FIG. 3A is a perspective view of a box 300 containing a plurality of hair coloring products 302, as might be commonly found in a home hair coloring kit. The over-garment 100 of the preferred embodiment illustrated in FIG. 1A and FIG. 1B is shown next to the box, folded in preparation for being placed in the box 300. FIG. 3B shows the folded over-garment 100 placed in the box on top of the hair coloring products 302, and ready to be sold to a customer as part of the hair coloring kit.

Figure 4A:
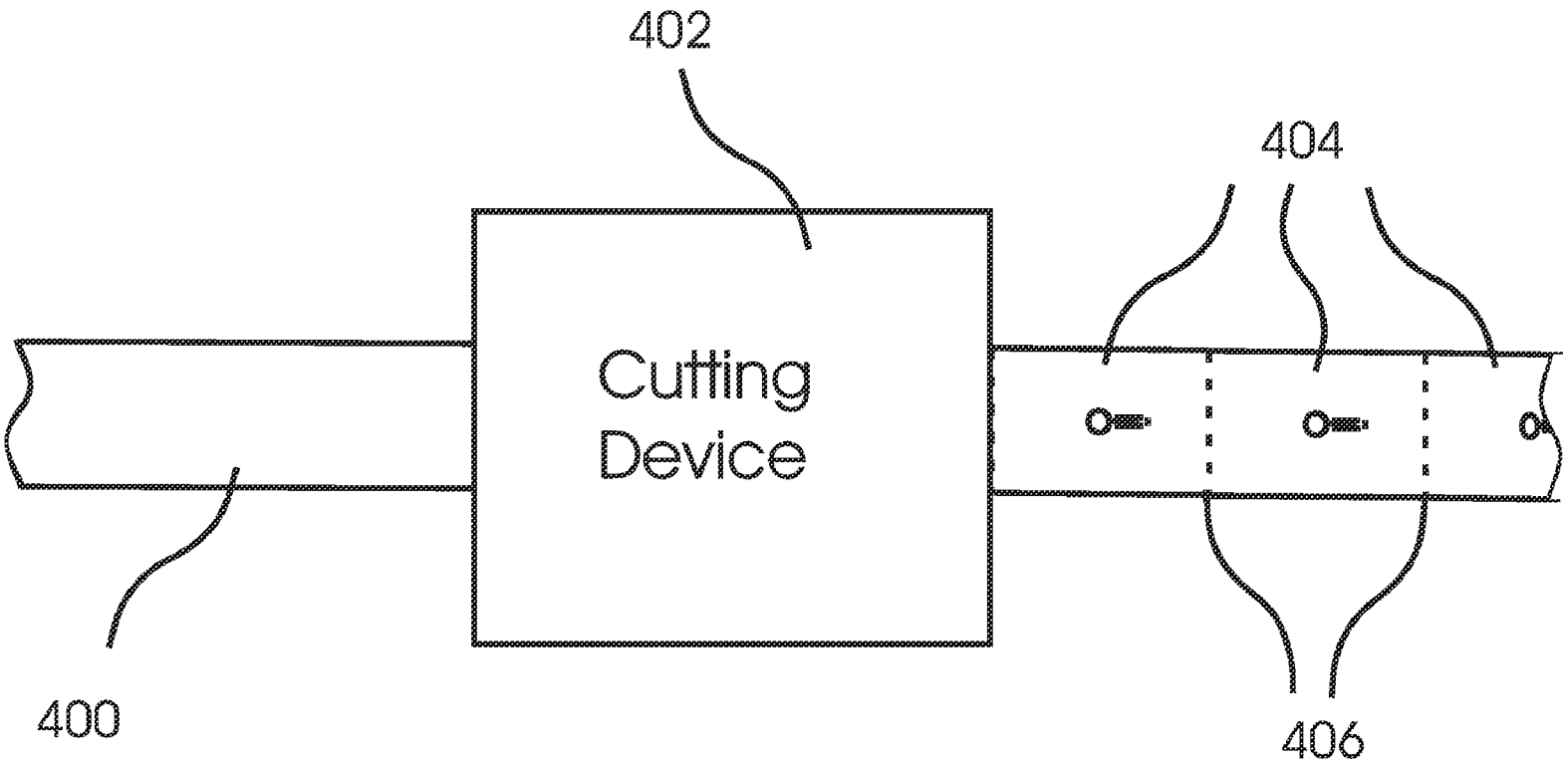
FIG. 4A is a simplified view from above of a continuous length of flexible material of a preferred embodiment being passed through a device that makes all of the required cuts and perforations, thereby producing a continuous length of sheets that are joined together at perforated intersections.

FIG. 4A is a simplified view from above of an embodiment in which a continuous length of the flexible material 400 is passed through a device 402 that makes all of the required cuts and perforations, thereby producing a continuous length of over-garment sheets 404 that are joined together at perforated intersections 406.

Figure 4B:
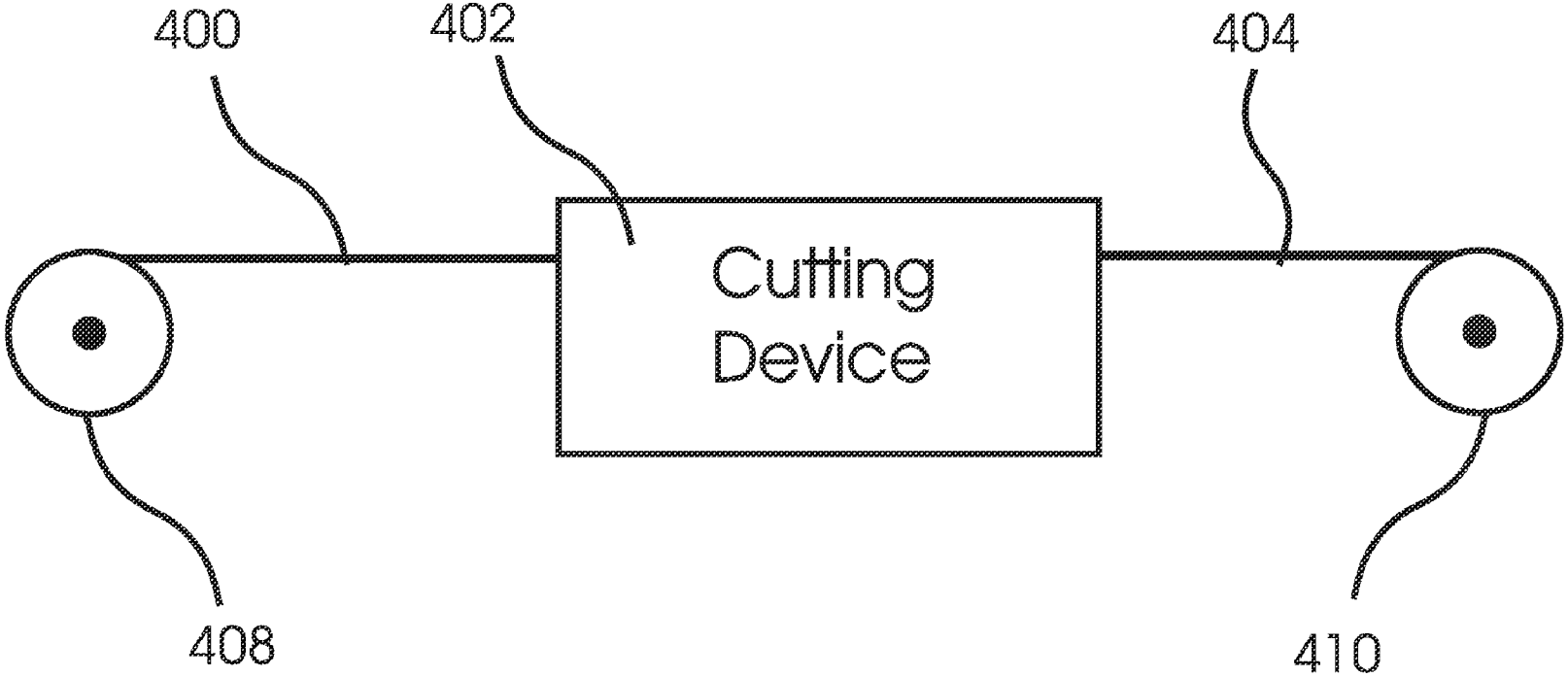
FIG. 4B is a simplified view from the side of the continuous length of flexible material of FIG. 4A, showing the continuous length of the flexible material being dispensed from a first roll, and a continuous length of sheets being collected onto a second roll.

FIG. 4B is a simplified view from the side of the embodiment shown in FIG. 4A, in which the continuous length of the flexible material 400 is dispensed from a first roll 408, and the continuous length of over-garment sheets 406 is collected onto a second roll 410.

Figure 5A:
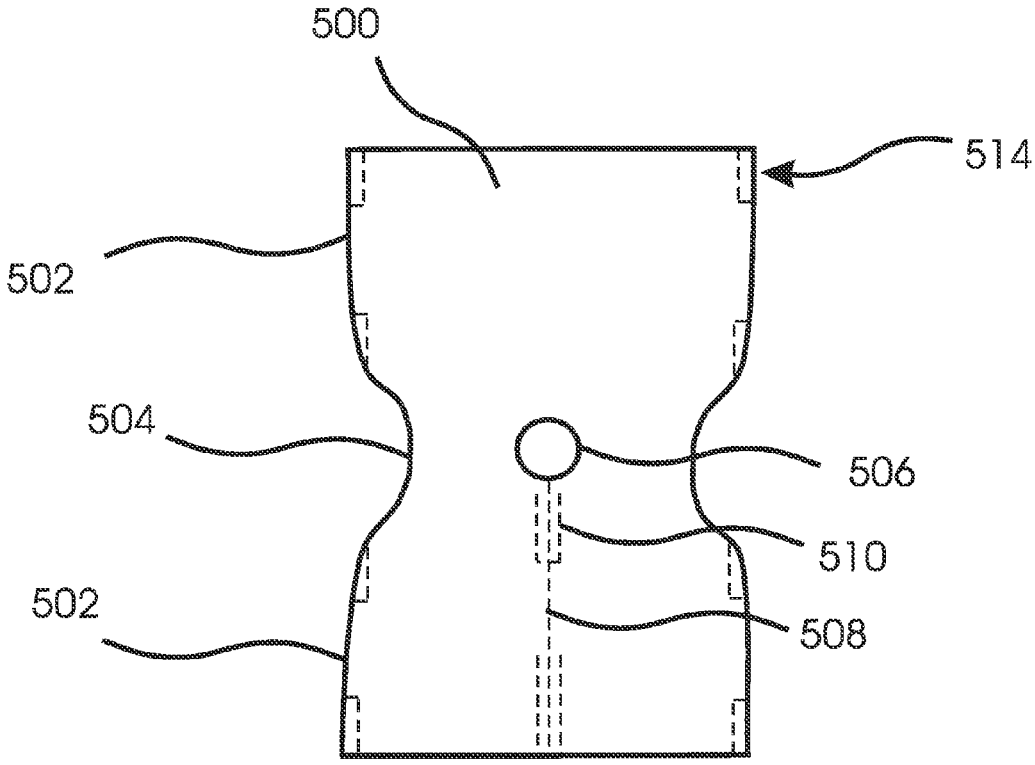
FIG. 5A is a view of the sheet of the present invention from above, in an embodiment where the sheet is approximately hourglass in shape and includes perforations for forming the first cut and the neck tying strips, as well as perforations for forming additional pairs of strips that can be tied together to hold the first cut and the sides of the garment together when the over-garment is worn.

FIG. 5A is a top view of a preferred embodiment in which the shape of the sheet 500 is approximately an hourglass, being wider at the ends 502 and narrower at the center 504. The sheet includes a hole approximately in the center 506 and perforations for forming the first cut 508 and the neck tying strips 510. In this embodiment, the first cut 508 extends to an edge of the sheet 500, thereby allowing the sheet 500 to be wrapped around the neck of an individual rather than passed over the head of the individual. This avoids any danger of disturbing the hair of the individual while putting the over-garment on or off. Due to the length of the first cut 508, the sheet 500 also includes perforations 512 for forming an additional pair of strips that can be tied together to hold the first cut 508 closed at a point removed from the neck hole 506. Additional perforations 514 are also included to form strips that can be tied together to hold the sides of the garment closed.

Figure 5B:
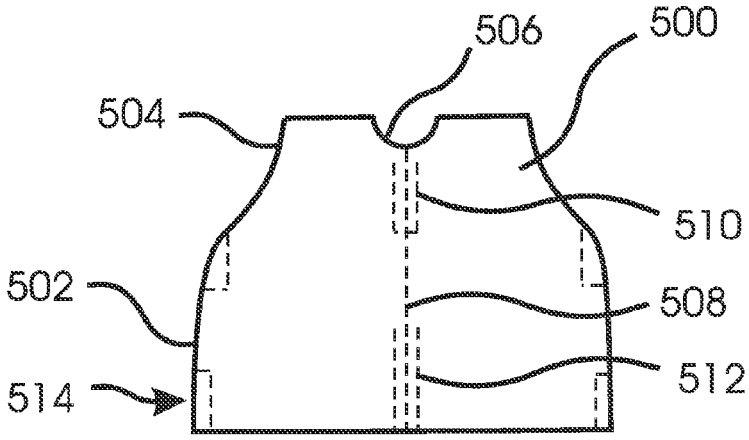
FIG. 5B is a view of the embodiment of FIG. 5A, with the sheet folded at the center to better show its shape as worn, which is narrower in the shoulders and broader at the hips.

FIG. 5B is a front view of the embodiment shown in FIG. 5A, with the sheet folded in half at the center 504 to illustrate its shape as worn, which is narrower in the shoulders 504 and broader at the hips 502.

Figure 6A:
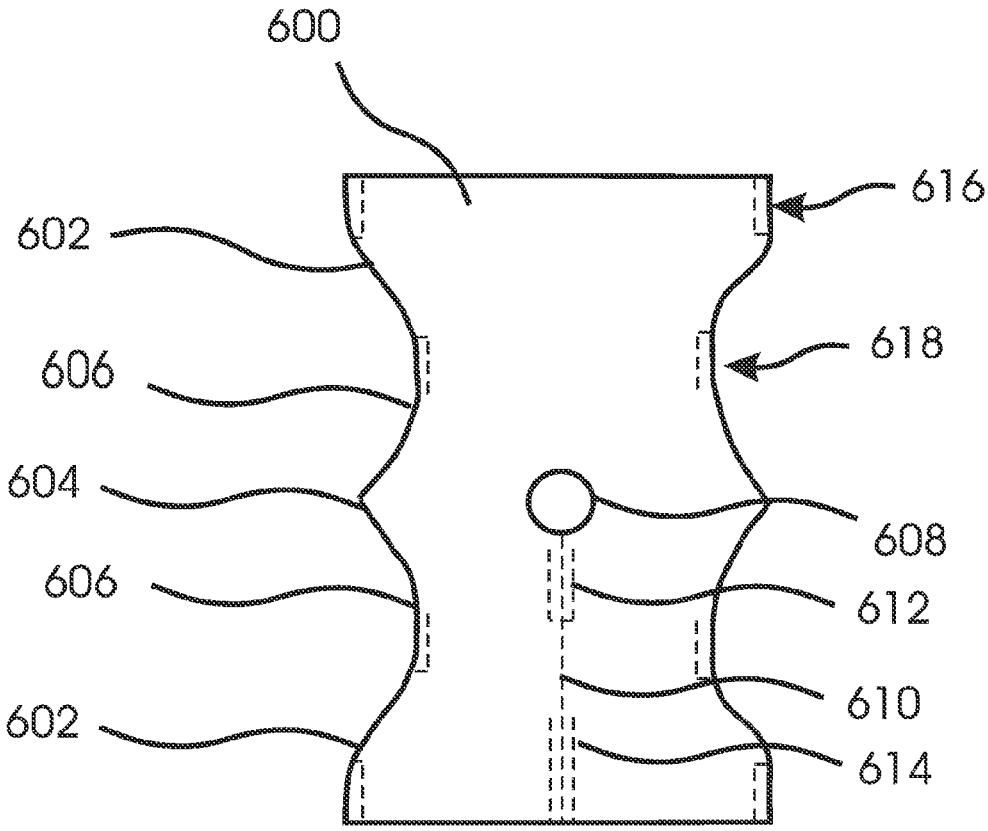
FIG. 6A is a view of the sheet of the invention from above, in an embodiment where the sheet is approximately double hourglass in shape and includes perforations for forming the first cut and the neck tying strips, as well as perforations for forming additional pairs of strips that can be tied together to hold the first cut and the sides of the garment together when it is worn.

FIG. 6A is a view from above of the sheet of an embodiment of the over-garment in which the shape of the sheet 600 is approximately a double hourglass, being wider at both ends 602 and in the middle 604 and narrower in between 606. The sheet includes a hole approximately in the center 608 and perforations for forming the first cut 610 and the neck tying strips 612, as well as perforations for forming an additional pair of strips 614 that can be tied together to hold the first cut closed, and additional perforations 616, 618 that can be tied together to hold the sides and bottom of the garment closed.

Figure 6B:
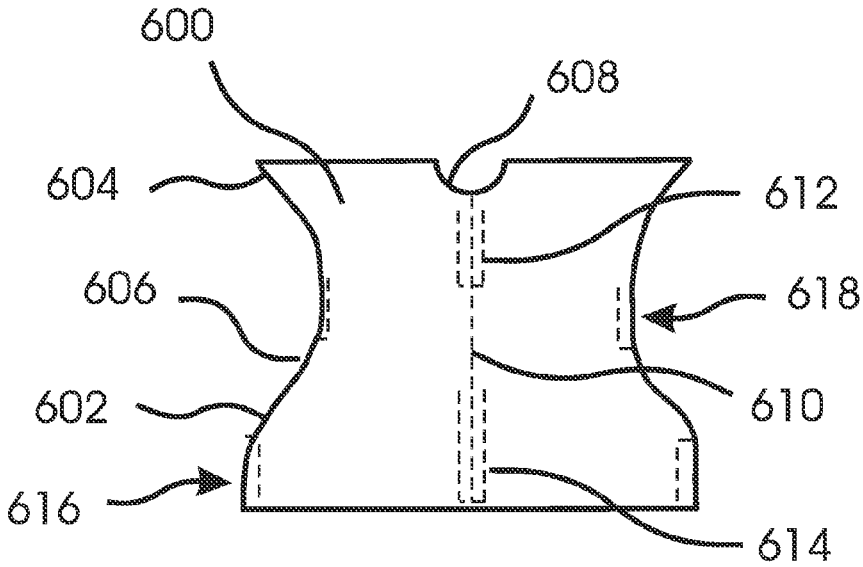
FIG. 6B is a view of the embodiment of FIG. 6A, with the sheet folded at the center to better show its shape as worn, which is broader at the shoulders and hips and narrower in the torso.

FIG. 6B is a view of the embodiment illustrated in FIG. 6A with the sheet 600 folded in half at the center to illustrate its shape as worn, which is broader at the shoulders 618 and hips 620 and narrower in the torso 622.

Figure 7A:
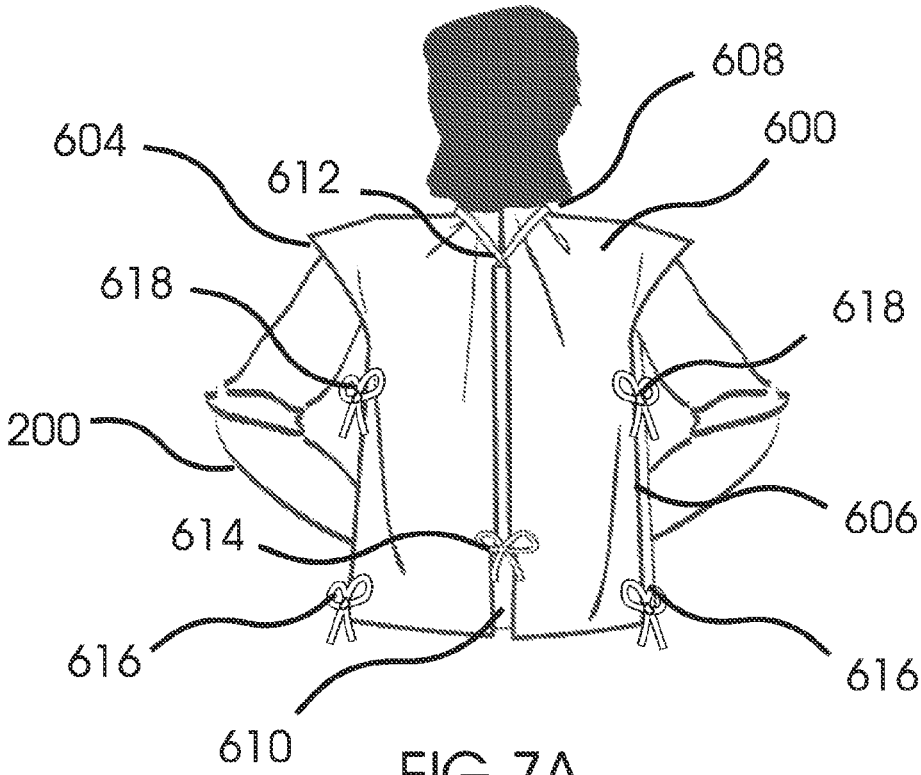
FIG. 7A is a perspective view from behind of a user wearing an embodiment of the invention where the first cut extends to the edge of the sheet, the neck tying strips are crossed and wrapped around the neck of the user, and additional pairs of strips are tied together to hold the first cut and the sides of the over-garment closed.

FIG. 7A shows a perspective rear view of a user 200 wearing the embodiment of the over-garment illustrated in FIG. 6A and FIG. 6B. As in the embodiment of FIG. 5A and FIG. 5B, in this embodiment, the first cut 610 extends to the edge of the sheet 600, so that the user's neck can be placed in the hole by wrapping the sheet around the user's neck, thereby avoiding any risk of disturbing the user's hair. In this embodiment, the neck tying strips 612 are long enough to cross over each other and extend around the user's neck, so that when the circumference of the user's neck is smaller than the circumference of the hole 608, the neck tying strips 612 can cause the edges of the first cut 610 to overlap near the user's neck, thereby holding the rim of the hole 608 firmly against the user's neck. Another pair of strips 618, formed by additional cuts that separate them from the sheet 600, have been tied together to hold the first cut 610 closed near the user's waist. Additional pairs of strips 616, 618 are tied together to hold the sides 606 of the sheet closed.

Figure 7B:
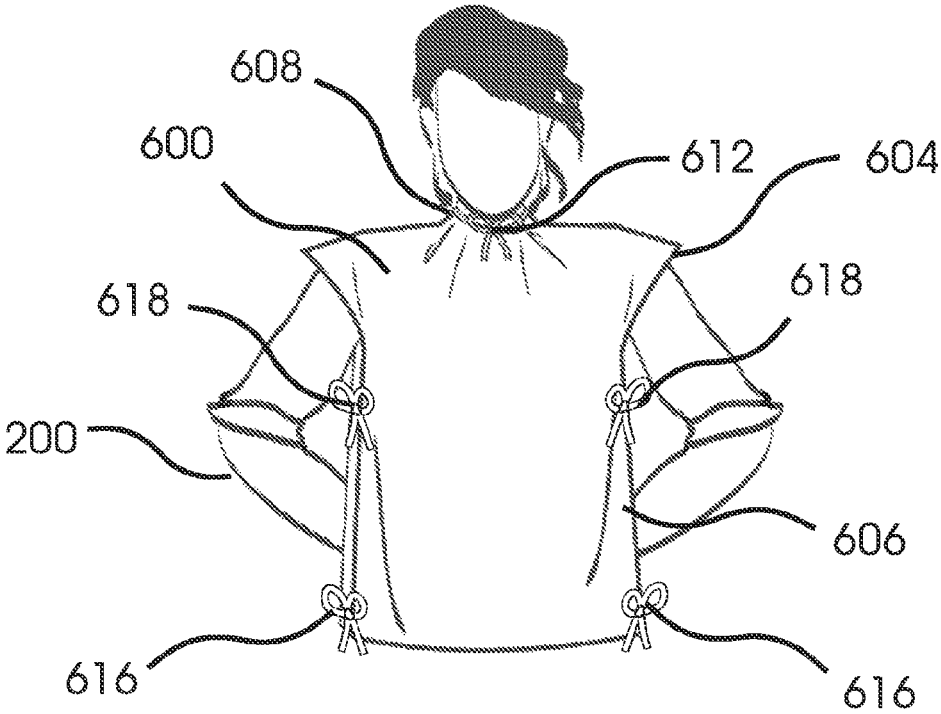
FIG. 7B is a perspective view from the front of a user wearing the embodiment of FIG. 7A.

FIG. 7B shows a front view of the user shown in FIG. 7A, where the neck tying strips 612 have been tied together at the front of the user's neck.

Other modifications and implementations will occur to those skilled in the art without departing from the spirit and the scope of the invention as claimed. Accordingly, the above description is not intended to limit the invention except as indicated in the following claims.

What is claimed is:

1. An over-garment, comprising:

a sheet of flexible material with a hole located approximately in the center, the hole being large enough to surround a human neck and the sheet having a size and shape sufficient to substantially cover the shoulders, upper arms, back, and chest of a user when the user wears the sheet by placing the hole around the user's neck;

a first cut radiating outward from the hole that can be opened to allow the user's head to pass through the hole; and a pair of neck tying strips that can be tied together to hold the rim of the hole firmly against the user's neck, the neck tying strips being formed parallel to and on either side of the first cut by a second cut and a third cut that partially separate the neck tying strips from the sheet.

2. The over-garment of claim 1, wherein the costs of the flexible material and of the method of manufacture are low enough to allow the over-garment to be disposable.

3. The over-garment of claim 1, wherein the size of the garment is small enough to allow at least one over-garment to be conveniently contained in packaging in which a home hair coloring kit is sold.

4. The over-garment of claim 1, wherein the size of the garment is small enough to allow at least one over-garment to be conveniently contained in a rectangular package that also contains a home hair coloring kit, the rectangular package measuring approximately 2 inches by 3 inches by 6 inches.

5. The over-garment of claim 1, wherein the flexible material is not permeable by liquids.

6. The over-garment of claim 3, wherein the sheet is made from plastic.

7. The over-garment of claim 1, wherein the shape of the sheet is approximately rectangular, having a recognizable width and length, with the lengths generally equal to or greater than the width, so that the over-garment is worn by a user with the length of the rectangle extending from the front of the user to the back of the user, thereby forming the front and back of the garment, and the width of the rectangle extending from one side of the user to another side of the user, thereby forming the sides of the garment.

8. The over-garment of claim 7, further comprising at least one pair of side tying strips that can be tied together to hold the sides of the garment closed while the garment is worn by a user, the side tying strips being formed on either side of the garment by cuts that partially separate the side tying strips from the sheet.

9. The over-garment of claim 7, wherein a plurality of over-garments can be manufactured by passing a continuous length of the flexible material through a device that makes all of the cuts and perforations.

10. The over-garment of claim 7, wherein a plurality of sheets can be manufactured as a continuous length of sheets that are joined together at perforated intersections.

11. The over-garment of claim 10, wherein the continuous length of sheets can be formed into at least one of a roll and a folded pile and appropriately packaged to facilitate at least one of transportation, storage, and dispensing.

12. The over-garment of claim 1, wherein the sheet has an approximately hour-glass shape, such that the width is greater near the ends of the length and narrower in the middle, thereby causing the sheet to be narrower at the shoulders and wider at the hips when it is worn by a user.

13. The over-garment of claim 1, wherein the sheet has an approximately double hour-glass shape, such that the width is greater near the ends of the length and in the middle, and narrower in between, thereby causing the sheet to be wider at the shoulders and hips and narrower in the torso when it is worn by a user.

14. The over-garment of claim 1, wherein at least one of the cuts is initially perforated, so that the perforation must be separated before the cut is first used.

15. The over-garment of claim 1, wherein the hole is initially a perforated circle, so that the portion of the sheet located inside of the perforated circle must be removed by separation of the perforation before the sheet is first used.

16. The over-garment of claim 1, wherein the neck tying strips can be crossed over each other, extended around the neck of a user wearing the sheet, and tied together, so that when the user's neck is smaller in circumference than the circumference of the hole, the edges of the first cut will overlap and the rim of the hole will be held firmly against the user's neck.

17. The over-garment of claim 1, wherein the first cut extends to the edge of the sheet so that the hole can be wrapped around the neck of a user without risk of disturbing the user's hair.

18. The over-garment of claim 1, wherein the sheet includes at least one pair of back tying strips that can be tied together to hold the first cut closed when a user is wearing the sheet, the additional tying strips being formed by cuts that partially separate the additional strips from the sheet.

19. The over-garment of claim 1, wherein the sheet is of sufficient dimensions to substantially cover a user's lap when the user is wearing the over-garment.

20. A method of using an over-garment to protect the shoulders, upper arms, back, and chest of a user and any clothing worn in those areas by the user, the method comprising:

providing an over-garment comprising a sheet of flexible material with a hole located approximately in the center, the hole being large enough to surround a human neck and the sheet having a size and shape sufficient to substantially cover the shoulders, upper arms, back, and chest of a user when the user wears the sheet by placing the hole around the user's neck, a first cut radiating outward from the hole that can be opened to allow the user's head to pass through the hole, and a pair of neck tying strips that can be tied together to hold the rim of the hole firmly against the user's neck, the neck tying strips being formed parallel to and on either side of the first cut by a second cut and a third cut that partially separate the neck tying strips from the sheet;

opening the first cut;

inserting the head of the user through the opening formed by the hole and the opened first cut;

allowing the sheet to rest on the shoulders of the user and orienting it so that it substantially covers the shoulders, upper arms, back, and chest of the user; and tying the neck tying strips together so as to hold the rim of the hole close to the user's neck.

* * * * *